US006069305A

United States Patent [19]

Matsuki

[11] Patent Number: 6,069,305

[45] Date of Patent: May 30, 2000

[54] STRUCTURE FOR SUPPORTING SOUND BOARD OF UPRIGHT PIANO

[75] Inventor: Yutaka Matsuki, Hamamatsu, Japan

[73] Assignee: Yamaha Corporation, Hamamatsu, Japan

[21] Appl. No.: 08/941,179

[22] Filed: Sep. 30, 1997

[30] Foreign Application Priority Data

Oct. 3, 1996 [JP] Japan ..... 8-262886

[51] Int. Cl.[7] ..... G10C 3/06

[52] U.S. Cl. ..... 84/192; 84/184; 84/186.1; 84/187; 84/190

[58] Field of Search ..... 84/184, 185, 186.1, 84/189–196

[56] References Cited

U.S. PATENT DOCUMENTS

| | | | |
|---|---|---|---|
| Re. 26,894 | 5/1970 | Graves | 84/192 |
| 2,174,074 | 9/1939 | Socin . | |
| 3,311,009 | 3/1967 | Graves . | |
| 5,339,717 | 8/1994 | Vagias | 84/192 |

FOREIGN PATENT DOCUMENTS

| | | |
|---|---|---|
| 327 155 | 10/1920 | Germany . |
| 3326006 | 1/1985 | Germany . |
| 8610 611 U | 10/1986 | Germany . |
| 7-319454 | 12/1995 | Japan . |

*Primary Examiner*—Robert E. Nappi
*Assistant Examiner*—Marlon T. Fletcher
*Attorney, Agent, or Firm*—Graham & James LLP

[57] ABSTRACT

A support structure is provided for supporting a sound board of an upright piano. A peripheral portion of the sound board is securely fixed to a sound board bearing shim, which is securely fixed to a back frame. The back frame is constructed by a plurality of posts, beams and a bottom sill. A pin block is attached to an upper portion of the main body of the upright piano above the sound board bearing shim. A support member is provided between the pin block and back frame and is made of the material having a high rigidity. An extending portion extends downwardly from a lower end of the support member. A front surface of the extending portion is attached to an upper portion of the sound board bearing shim. Herein, a thinned portion is formed by cutting a back portion of the extending portion. The extending portion is formed as an integral part of the support member but is different from the support member in thickness. So, the extending portion separates from the back frame. Such a construction of the support member and extending portion acts like a vibrating substance of cantilever support which vibrates together with the sound board and sound board bearing shim. Meanwhile, it is possible to provide a thinned (or hollowed) portion for the back frame at a position which substantially faces with the upper portion of the sound board bearing shim. This brings reduction of rigidity of the sound board assembly of the upright piano as a whole. Thus, it is possible to provide improvements in tone volume and sound quality of the upright piano.

6 Claims, 3 Drawing Sheets

STRUCTURE FOR SUPPORTING SOUND BOARD OF UPRIGHT PIANO

BACKGROUND OF THE INVENTION

1. Field of the Invention

This invention relates to a structure for supporting a sound board of an upright piano.

2. Prior Art

In the piano, a hammer strikes a string to produce vibration energy, which is subjected to diffusing propagation onto an overall area of a sound board. Thus, the piano is capable of producing a sound whose tone volume is sufficiently large. The piano provides a structure for supporting a sound board. According to such a support structure of the sound board, in the case of an upright piano, a peripheral portion of the sound board is securely fixed to a sound board bearing shim (or sound board base) (which may be called "uchima-washi"in Japanese), which is then fixed to a back frame.

The support structure of the sound board of the upright piano conventionally known is shown in FIGS. 4A and 4B. Herein, FIG. 4A is a front view of the support structure while FIG. 4B is an enlarged sectional view taken along the line I—I of FIG. 4A. A numeral '1' designates a number of posts, which correspond to a back frame having a vertical lattice pattern. The back frame 1 is constructed by an upper beam 2, a middle beam 3 and a bottom sill 4, for example. The back frame 1 is stored in a perpendicular form within a body of a musical instrument (not shown). A pin block 5 is fixed to an upper end portion of a front side of the back frame 1 in connection with the upper beam 2 and the middle beam 3. In addition, a sound board bearing shim 7 is securely fixed to the back frame 1. An upper end portion of a frame 8 which is formed by casting is fixed to the back frame 1 and the pin block 5. The sound board bearing shim 7 is constructed by a framework 11 and two diagonal beams 13*a*, 13*b*. Herein, the framework 11 is constructed by assembling an upper frame beam 9*a* and a lower frame beam 9*b* as well as vertical frame beams 10*a*, 10*b*. Each of the above beams is made by a hard rectangular lumber (i.e., hard beam) whose size in section ranges from 30 mm to 40 mm, for example. The diagonal beams 13*a*, 13*b* are arranged inside of the framework 11. That is, the diagonal beam 13*a* is arranged to form a small triangle area at an upper-left corner of the framework 11. Similarly, the diagonal beam 13*b* is arranged to form a small triangle area at a lower-right corner of the framework 11. A peripheral portion of a sound board 6 is attached (or glued) to faces of the above beams by an adhesive agent. An upper portion (or upper frame) of the sound board bearing shim 7 is glued to the middle beam 3, whilst a lower end portion is glued to the bottom sill 4.

A crown is formed for the sound board 6 to have a convex curved surface at its front-face side. A base bridge 18 and a treble bridge 19 are respectively glued to a front face of the sound board 6. Herein, the base bridge 18 supports intermediate portions of strings 15 provided for a bass section, whilst the treble bridge 19 supports intermediate portions of strings 16, 17 provided for a tenor section and a treble section respectively. Tuning pins 20 are planted onto an upper end portion of the frame 8, whilst frame pins 21 are planted onto a lower end portion of the frame 8. Ends of the strings 15, 16 and 17 are terminated by the tuning pins 20 and the frame pins 21. Thus, a certain level of tension is imparted to the strings. A number of sound board ribs 22 are glued to a back surface of the sound board 6. Herein, the sound board ribs 22 are arranged substantially perpendicular to a grain direction of the sound board 6. Both ends of the sound board ribs 22 are glued to the sound board bearing shim 7.

In the conventional support structure of the sound board described above, vibration of the sound board 6 is transmitted to the back frame 1 through the sound board bearing shim 7. Hence, if a high impedance (or high rigidity) is set to the post of the sound board bearing shim, a sound board assembly as a whole would have a high impedance to string vibration. The impedance of the sound board of the conventional upright piano is so high that it is difficult to optimize the impedance matching between the strings and sound board; therefore, the conventional upright piano suffers from a problem that reduction occurs in sound quality and tone volume.

SUMMARY OF THE INVENTION

It is an object of the invention to provide a structure for supporting a sound board which is capable of improving sound quality and tone volume by reducing impedance of the sound board (assembly) of an upright piano.

A support structure of this invention is provided for supporting a sound board of an upright piano. Herein, a peripheral portion of the sound board is securely fixed to a sound board bearing shim at its bottom portion, to a back frame. A pin block is also attached to an upper portion of the back frame of the upright piano above the sound board bearing shim. A support member is provided between the pin block and back frame and is made of a material having a high rigidity. An extending portion extends downwardly from a lower end of the support member. A front surface of the extending portion is attached to an upper portion of the sound board bearing shim. In addition, a thinned portion is formed by cutting a back portion of the extending portion. As a result, the extending portion is formed as an integral part of the support member but is different from the support member in thickness. So, the extending portion separates from the back frame.

The above construction of the support member and extending portion acts like a vibrating substance of cantilever support which vibrates together with the sound board and sound board bearing shim.

Additionally, it is possible to provide a thinned portion in the middle beam at a position which substantially faces with the upper portion of the sound board bearing shim. For example, a part of the middle beam within the back frame is cut to form the thinned portion. This reduced the rigidity of the sound board assembly of the upright piano as a whole.

Thanks to the construction of this invention, it is possible to provide improvements in tone volume and sound quality of the upright piano.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Figure 1:
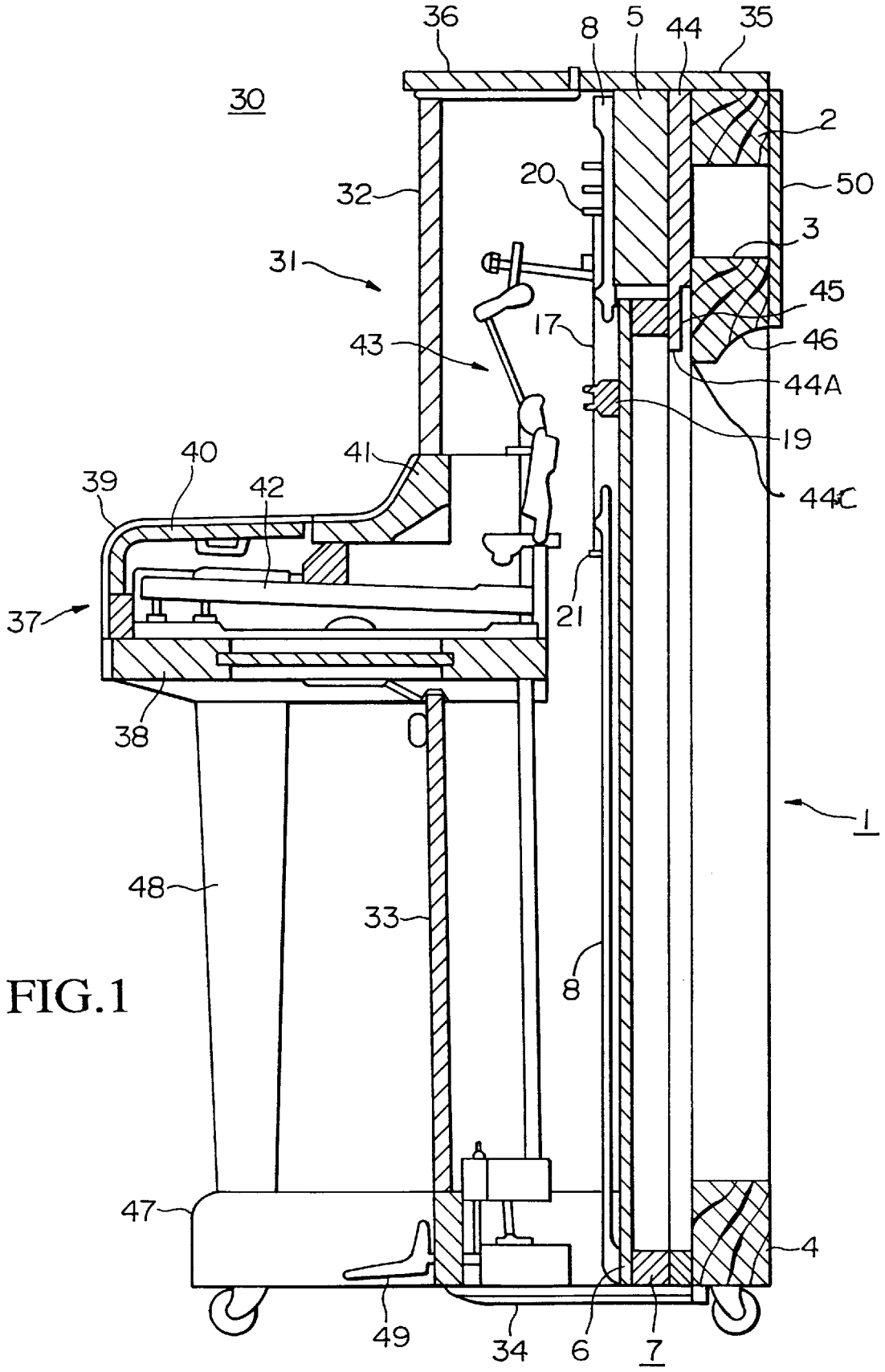
FIG. 1 is a traverse sectional view showing a support structure of a sound board of an upright piano in accordance with an embodiment of the invention.
Figure 4B:
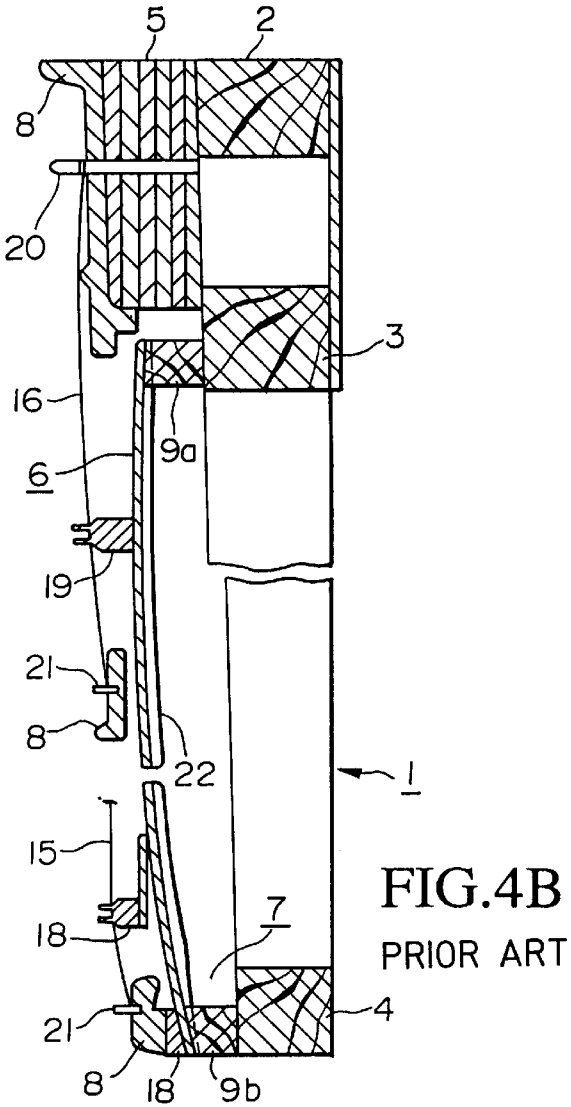
FIG.4B PRIOR ART
FIG. 4B is a sectional view taken along the line I—I of FIG. 4A.
Figure 4A:
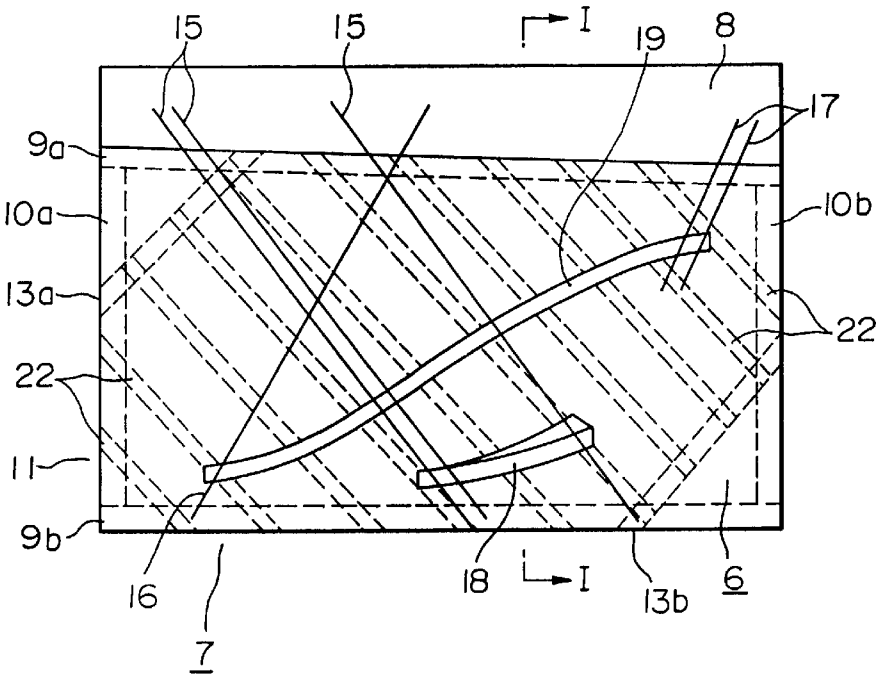
FIG.4A PRIOR ART
FIG. 4A is a front view showing a conventional example of a support structure of a sound board of an upright piano.

FIG. 1 is a traverse sectional view showing a support structure of a sound board of an upright piano in accordance with an embodiment of the invention. In FIG. 1, parts equivalent to those of the aforementioned FIGS. 4A and 4B will be designated by the same numerals; hence, the description thereof will be omitted occasionally. FIG. 1 shows a construction of an upright piano 30 which contains a main body 31 having a rectangular box-like shape. The main body 31 of the upright piano 30 is constructed by an upper front board 32, a lower front board 33, a bottom board 34, a top board rear 35 and a top board front 36. Herein, a human operator can manipulate the top board front 36 to open or close. A keyboard unit 37 is provided between the upper front board 32 and the lower front board 33 to project in a front direction of the upright piano 30. The keyboard unit 37 is constructed using a key bed 38, a pair of arms 39, a fall board 40 and a fall board upper sill 41. Herein, a pair of arms 39 are arranged at both sides of the key bed 38 respectively. A keyboard 42 containing eighty-eight keys is mounted on the key bed 38. In addition, a number of action mechanisms 43 are arranged on the key bed 38 as well. Herein, the action mechanism 43 operates in response to depression of the keys of the keyboard 42 to strike the strings 15, 16 and 17.

The back frame 1 is arranged in a substantially perpendicular form to hold (or support) the main body 31 of the upright piano 30. The pin block 5 is glued to an upper front surface of the back frame 1 through a support member 44. In addition, the sound board bearing shim 7 which supports the sound board 6 is securely fixed at its lower end to the back frame 1.

The support member 44 is made by the material having a high rigidity. That is, the support member 44 is manufactured using the hard wood materials such as the beech, spruce, matoa and hard laminated plywood. An extending portion 44A is formed as an integral part of the support member 44. Herein, the extending portion 44A extends downwardly from a lower end of the pin block 5. A thinned portion 45 is formed at a back side of the extending portion 44A. So, a thickness of the extending portion 44A can be made small as compared to a thickness of the support member 44. As a result, the extending portion 44A separates from a front surface of the back frame 1 by an appropriate amount of spacing. An upper portion of the sound board bearing shim 7 is securely fixed to a front surface 44C of the extending portion 44A. For this reason, the upper portion of the sound board bearing shim 7 perfectly separates from the middle beam 3 which is one of the members constructing the back frame 1. The thinned portion 46 is formed along an overall length of the middle beam 3 in its longitudinal direction. Herein, the thinned portion 46 can be formed continuously or discontinuously. Moreover, the upright piano of FIG. 1 provides toe block 47, leg posts 48, pedals 49 and a beam back 50. Other parts which are not described specifically in conjunction with FIG. 1 correspond to the aforementioned parts of the conventional support structure of the sound board shown in FIGS. 4A and 4B.

Figure 2:
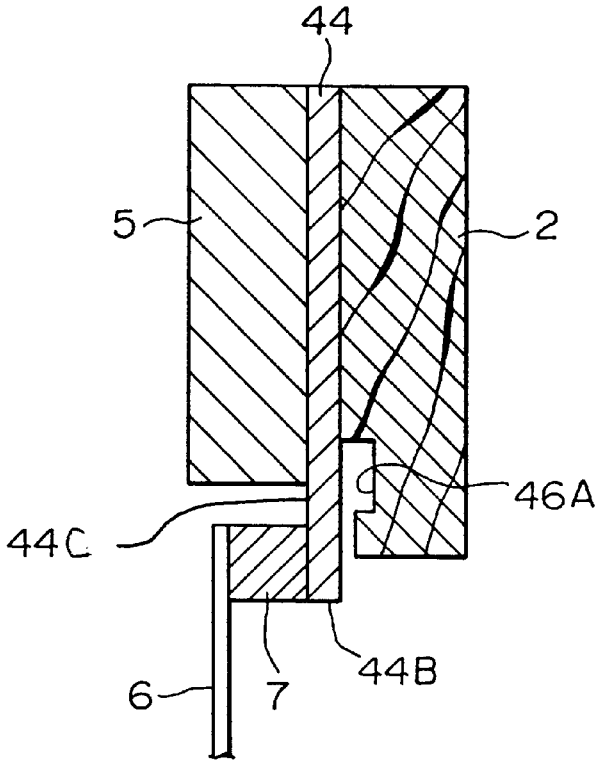
FIG. 2 is an enlarged view showing an essential part of the support structure of the sound board in accordance with another example of the invention.
Figure 3:
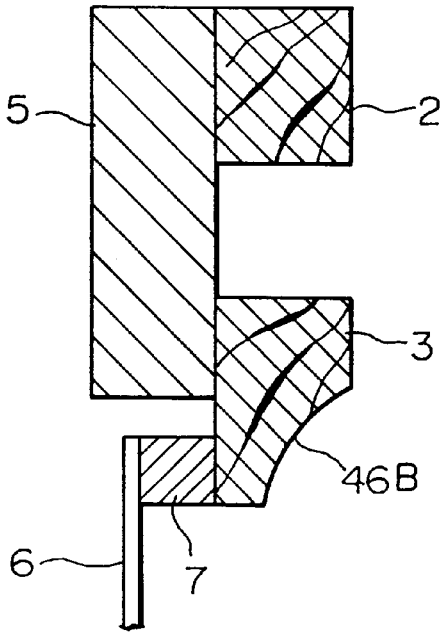
FIG. 3 is an enlarged view showing an essential part of the support structure of the sound board in accordance with a further example of the invention.

According to the present embodiment of FIG. 1, the thinned portion 46 is formed with respect to the extending portion 44A of the support member 44, wherein formation thereof brings reduction of the rigidity of the sound board assembly as a whole. Of course, it is possible to provide another method for the reduction of the rigidity of the sound board assembly. For example, the thinned portion 46 can be formed in proximity to the beams as shown in FIG. 2 and FIG. 3. In case of FIG. 2, a lower end of the support member 44 is extended to form an extending portion 44B, which has a same thickness of the support member 44. Herein, the upper portion of the sound board 6 is securely fixed to the extending portion 44B through the sound board bearing shim 7. In addition, the upper beam 2 is made longer than that of FIG. 1, so that the middle beam 3 is omitted. So, a thinned portion 46 is formed to partially cut a front portion of the upper beam 2 at a position which substantially matches with the extending portion 44B. In case of FIG. 3, the support member is not used, so that the pin block 5 is directly fixed to the upper beam 2 and the middle beam 3. In addition, the sound board bearing shim 7 is glued to a front surface of the middle beam 3. Further, a hollowed portion 46B is formed to partially cut a back portion of the middle beam 3.

According to the examples of the support structure of the sound board described above, the extending portion 44A (or 44B) is formed as an integral part of the support member 44 which is located between the back frame 1 and the pin block 5, wherein the extending portion extends downwardly from the lower end of the support member 44 and separates from the back frame 1 by certain spacing. Herein, the upper frame of the sound board bearing shim 7 is securely fixed to the extending portion.

We have made studies on the support structure of the sound board of the upright piano whose construction is described above. Based on results of the studies, we have confirmed that the present embodiment has a variety of improvements in sound quality.

The extending portion 44A can be assumed as a vibrating substance of cantilever support. So, the extending portion 44A vibrates together with the sound board 6 and the sound board bearing shim 7. By changing the material of the support member 44 and by changing a shape of a cross section of the extending portion 44A, it is possible to adjust rigidity of the extending portion 44A which supports the upper portion of the sound board bearing shim 7. In the aforementioned modifications shown in FIG. 2 and FIG. 3, the thinned portion is provided with respect to the back frame at a position which substantially corresponds to the upper portion of the sound board bearing shim 7. These modifications are also capable of providing improvements (or effects) similar to the aforementioned ones of the embodiment using a thinned support member. That is, it is possible to set an optimum tone volume and an optimum sound quality for the sound of the upright piano in accordance with the modifications shown in FIG. 2 and FIG. 3.

As described heretofore, the examples of this invention are very simple in construction because they merely require provision of the extending portion which extends from the support member. So, this invention is capable of offering great improvements in tone volume as well as sound quality with a simple construction which requires a small amount of cost for manufacturing.

Incidentally, FIG. 1 shows that the extending portion 44A and the thinned portion 46 are simultaneously provided in the back frame 1. Such an illustration of FIG. 1 is used to simplify the explanation of the embodiment. According to the inventor of this invention, the back frame 1 requires either the extending portion 44A or the thinned portion 46. In other words, it is not required to provide both of the extending portion 44A and the thinned portion 46 simultaneously.

Finally, it can be said that this invention can offer a variety of effects as follows:

It is possible to reduce impedance of the support structure of the sound board. In addition, it is possible to easily provide a broad range of variations with respect to the impedance of the support structure of the sound board.

Variations of the impedance can be easily achieved by changing parameters of construction, i.e., the taper amount (e.g., width and thickness) of the support member, the position at which the middle beam is cut and the amount by which the middle beam is cut, for example. As compared with the range of variations which the conventional upright piano is capable of providing with respect to the impedance of the support structure of the sound board, this invention is capable of providing a broader range of variations by merely changing the parameters of construction. As a result, this invention is capable of offering a great degree of freedom in design and manufacturing of the upright piano while providing rich sound quality as well as a variety of sounds.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A structure for supporting a sound board of an upright piano comprising:

a back frame which contains a plurality of posts;

a pin block which is attached to an upper portion of the back frame of the upright piano;

a sound board bearing shim whose front is attached to a peripheral portion of the sound board of the upright piano, wherein the sound board bearing shim is positioned between the back frame and the sound board and beneath the pin block; and a thinned portion which is formed as a partially cut back portion of the back frame at a back position where an upper portion of the sound board bearing shim is located.

2. A structure for supporting a sound board on an upright piano comprising:

a sound board bearing shim attached to a peripheral portion of the sound board;

a back frame;

a pin block which is attached to an upper portion of the back frame;

a support member which is provided between the pin block and the back frame, wherein the support member includes an extended portion which extends downwardly from the support member and the extended portion is separated from the back frame by a spacing and the sound board bearing shim is attached to a surface of the extended portion which is opposite to the spacing.

3. The structure according to claim 2, wherein the support member is comprised of a material having a high rigidity.

4. The structure according to claim 2, wherein the support member has a first thickness at a portion over the pin block, and the extended portion has a second thickness which is thinner than the first thickness.

5. The structure according to claim 2, wherein the support member has a first thickness and the extended portion has the first thickness, and a recess is formed in the back frame at a portion associated with the extended portion.

6. A structure for supporting a sound board on an upright piano comprising:

a sound board bearing shim attached to a peripheral portion of the sound board;

a back frame having a first portion having a first thickness and a second portion having a second thickness which is thinner than the first thickness;

a pin block which is attached to an upper portion of the back frame of the upright piano;

wherein the sound board bearing shim is attached to a surface of the second portion of the back frame.

* * * * *